United States Patent [19]

Nied et al.

[11] Patent Number: 4,528,091

[45] Date of Patent: Jul. 9, 1985

[54] PARTICLE CLASSIFIER

[75] Inventors: Roland Nied, Bonstetten; Herbert Horlamus, Augsburg; Fritz Kaiser, Neusaess, all of Fed. Rep. of Germany

[73] Assignee: Alpine Aktiengesellschaft Augsburg, Augsburg, Fed. Rep. of Germany

[21] Appl. No.: 574,686

[22] Filed: Jan. 27, 1984

[30] Foreign Application Priority Data

Jan. 29, 1983 [DE] Fed. Rep. of Germany ..... 3303078

[51] Int. Cl.[3] ..... B07B 7/08

[52] U.S. Cl. ..... 209/139 R

[58] Field of Search ..... 209/3, 143, 138–141, 209/144, 147, 148

[56] References Cited

U.S. PATENT DOCUMENTS

| | | | |
|---|---|---|---|
| 234,724 | 11/1880 | Prinz | 209/148 |
| 969,971 | 9/1910 | Morscher | 209/144 |
| 1,933,606 | 11/1933 | Sturtevant | 209/139 R |
| 2,269,412 | 1/1942 | Sturtevant | 209/144 |
| 3,269,537 | 8/1966 | Kaiser | 209/144 |
| 3,384,238 | 5/1968 | Alpha | 209/139 |
| 4,388,183 | 6/1983 | Thomas | 209/148 |

*Primary Examiner*—Charles Hart

*Attorney, Agent, or Firm*—Pennie & Edmonds

[57] ABSTRACT

A particle classifier comprising a casing, at least two separating wheels, a guide baffle, and a discharge conduit. The casing has a classification chamber and one or more openings that are provided to conduct air and particulate material into the classification chamber and to discharge course particles therefrom. The separating wheels are mounted in the classification chamber, and each wheel includes a multitude of blades forming openings for conducting fine particles into the interiors of the separating wheels. The guide baffle conducts air and particulate material entrained therewith upward to the separating wheels. The discharge conduit conducts from the separation chamber fine particles passing between the blade of the separating wheels.

9 Claims, 2 Drawing Figures

PARTICLE CLASSIFIER

BACKGROUND

This invention generally relates to apparatus for classifying particles; and, in particular, to apparatus for separating particles smaller than a given size—referred to as the particle classification or cut-point size—from a mixture of particles.

More specifically, the present invention relates to a particle classifier comprising a vertically disposed classification chamber with a cylindrical top part and a funnel-shaped bottom part, and a separator mounted in said top part and having the form of a rotating wheel. The rotating wheel has a multitude of blades arranged in the form of a blade ring, with each blade extending parallel to the axis of rotation of the wheel. Material to be classified is conveyed, either together with air entering through a lower opening in the funnel-shaped bottom part or directly, into the classification chamber. Coarse material is carried away through the lower opening of the funnel-shaped bottom part; and fine material, together with the air from the rotating wheel, is drawn off through an outlet exiting upward from the classifier.

A classifier of the type described above wherein the material to be classified is conveyed to the classification chamber while dispersed in air, is described, for example, in British Pat. No. 927,876. Another classifier of the same general kind but with direct conveyance of the material being classified to the separation chamber is shown in German Pat. No. 17 57 582, which corresponds to U.S. Pat. No. 3,384,238. The particle classification size achievable with such prior art classifiers is essentially a function of the diameter and circumferential velocity of the separating wheel. Thus, with a given size of wheel, the higher the circumferential velocity of the wheel, the smaller is the particle classification size. With an increase of the wheel velocity, however, there is also a rapid increase in wear and energy consumption so that an economical operation can be realized only if the particle classification size is kept above a certain size.

On the other hand, when the circumferential velocity of the wheel and the radial velocity of the separating air at its entry into the wheel at the wheel circumference are kept constant, the particle classification size becomes greater with an increasing wheel diameter, i.e. it is moved into a larger size range. If therefore, a large separating wheel is to have the same particle classification size as a small one, then the circumferential velocity of the larger wheel must be greater than the circumferential velocity of the smaller wheel. This means, however, that in addition to increased wear and energy consumption, stability and bearing problems also have to be expected. As the diameter of the separator wheel increases, the capacity of the wheel also increases.

SUMMARY OF THE INVENTION

It is therefore an object of this invention to create a particle classifier of the above described type with which high outputs can be achieved in the extremely fine particle range in an economical way and while overcoming the drawbacks mentioned above. This object is achieved by locating at least two identical, driven wheels, designed for fine particle separation, in the classification chamber of a particle classifier. As opposed to a mere parallel connection of individual, small separators, the arrangement of the present invention has the advantages of being more compact and requiring only a single fine particle discharge conduit and only a single device to feed the material to be classified into the classification chamber.

The material being classified can be dispersed in the separating air in a manner known per se and, together with the latter, be fed into the particle classifier through a lower opening of a bottom part of the particle classifier. In this way, the particle classifier can, for example, also be combined in a particularly simple manner with an air-driven extremely fine mill, particularly a moving bed jet mill, by fastening the mill from below to the bottom part of the particle classifier of this invention. The ground material raised from the mill by the air used therein then becomes the material to be conveyed to the particle classifier, and the air used for the milling becomes itself the separating air.

The separating wheels can be positioned so that their axes of rotation lie in a plane at right angles to the axis of the separator, or on the surface of a circular cone whose axis is the axis of the separator. If the rotational axes of the separator wheels extend radially relative to the separator axis, a centrally located outlet, common to all the separating wheels, may be provided to receive air and fine material from those separating wheels—an arrangement that is of an especially simple nature.

In another embodiment that is particularly well suited for classifying large quantities of particles, the rotational axes of the separating wheels lie in a plane at right angles to the axis of the classifier and extend parallel to each other, and adjacent separating wheels are staggered relative to one another by at least the height, or axial length, of a given separating wheel. With this arrangement, a large number of separating wheels can be accomodated within a relatively small space, without the separating wheels being adversely affected by the coarse material thrown off by the separating wheels during operation of the particle classifying device.

Preferably, separating wheels are used which, in a manner known per se, have a multitude of narrow blades extending radially or diagonally relative to the circumference of the separating wheel. The sizes of the particulate material deflected by such blades is substantially independent of the quantity of particulate material fed to the separating wheels and of the distribution of particle sizes in that material, making those blades particularly well suited to accomplish the given task.

An operation of several identical separating wheels in a common classification chamber assumes, of course, that all separating wheels can be set to the same speed of rotation as determined by the desired particle classification size, and that the so determined speed of rotation is kept constant. It is preferable, therefore, to provide for that purpose a control means common to all separating wheels. This control means may comprise, for example, a frequency converter by which the motors of all separating wheels are jointly driven.

BRIEF DESCRIPTION OF THE DRAWINGS

An embodiment of the invention is illustrated in the drawings, in which.

DETAILED DESCRIPTION OF THE PREFERRED EMBODIMENTS

Figure 1:
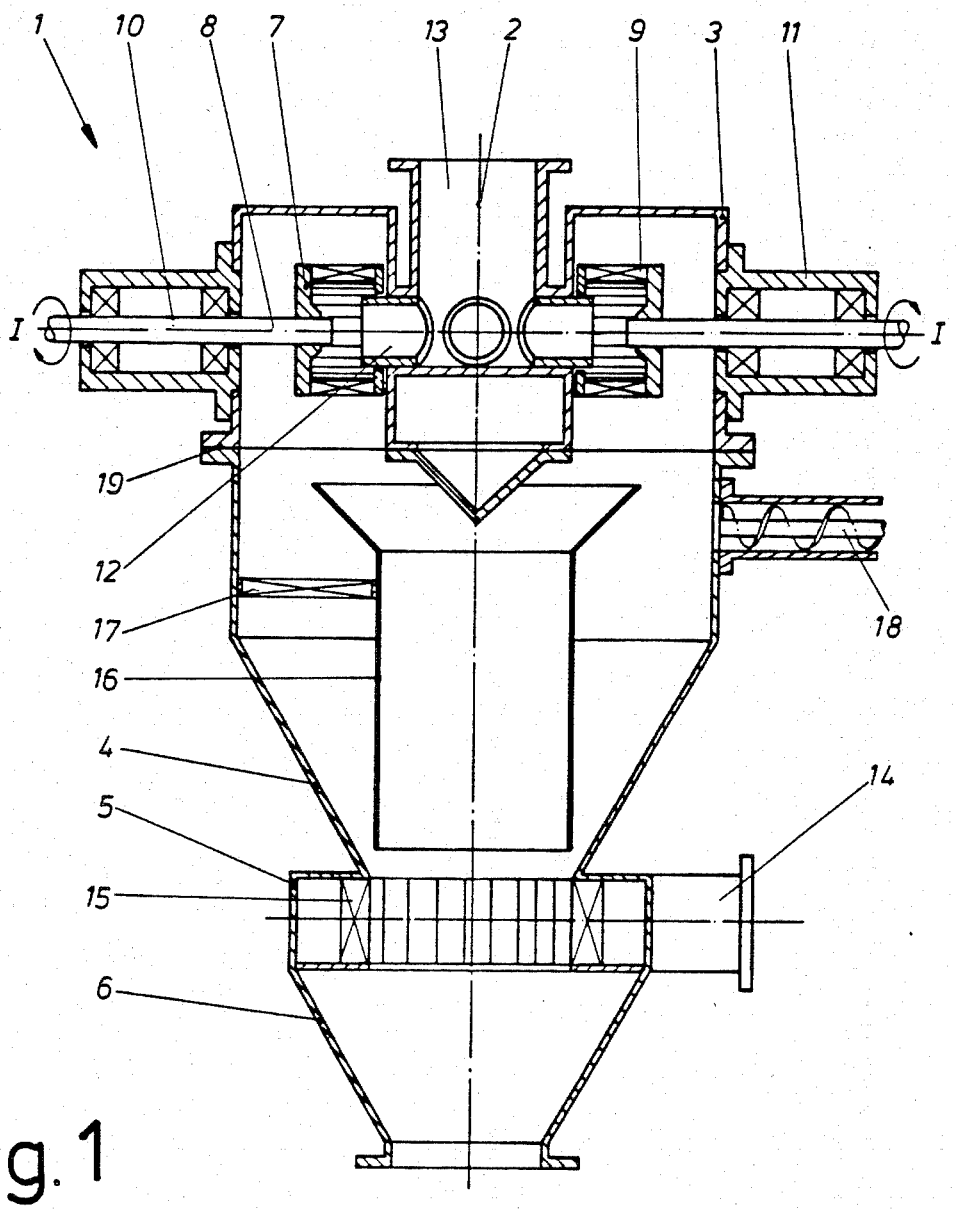
FIG. 1 shows a longitudinal section through a particle classifier having four separating wheels.
Figure 2:
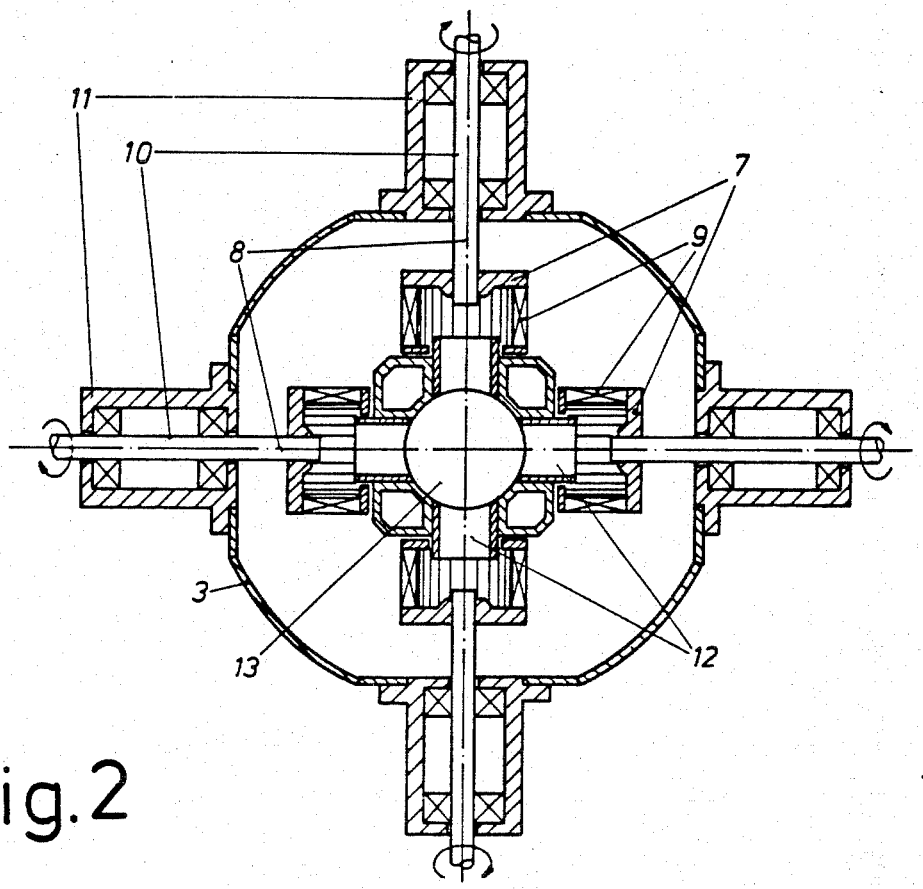
FIG. 2 shows a cross section along line I—I of the particle classifier in FIG. 1.

FIGS. 1 and 2 show a particle classifier 1 with a vertical axis 2 whose classification chamber comprises a cylindrical top part 3 and a funnel-shaped bottom part 4. A cylindrical container 5, with particle discharge funnel 6, adjoins the funnel-shaped bottom part 4 for the conveyance of separating air. The outer diameter of cylindrical container 5 is greater than the diameter of the lower opening of the funnel-shaped bottom part 4, and a separating air conduit 14 opens tangentially into cylindrical container 5. In the top part 3, four separating wheels 7 are supported for rotation about axes 8. Axes 8 lie in a plane at right angles to the classifier axis 2 and extend radially relative to the latter axis. Separating wheels 7 are designed as blade wheels having a multitude of narrow blades 9 extending radially or diagonally relative to the circumference of the separating wheel. Each separating wheel 7 sits on a shaft 10 which is housed in a bearing 11 fastened laterally to top part 3. Each separating wheel 7 is rotated by pulleys (not shown) which are operated by a three-phase motor, all of the said three-phase motors being driven jointly by a frequency converter.

Ends of the separating wheels 7 are open, and open pipe sections 12 extend into these ends of the separating wheels to conduct the fine material-charged separating air from inside the wheels 7 to a central outlet discharge 13. Outlet 13, in turn, is attached via a pipe line (not shown) to a separator for the fine material.

The direction of the flow of the entering separating air is determined by guide blades 15, which are disposed parallel to classifier axis 2. During operation of particle classifier 1, an airtight discharge means, e.g. a cell sluice (not shown) for the separated coarse material falling to the bottom of the particle classifier, is fastened to a flange of outlet funnel 6.

For a further improvement of the efficiency of the particle classifier, a guide baffle 16 is disposed inside classification chamber 3, 4, concentrically about the axis of the separator 1. A bottom section of baffle 16 is shaped as a cylindrical jacket. A top section of the guide baffle is shaped as a truncated cone jacket, widening in the upward direction and having an upper edge spaced from separating wheels 7. The diameter of the cylindrical jacket section of baffle 16 corresponds to the diameter of the lower opening of bottom part 4. Guide baffle 16 is joined to the top part 3 by means of three struts 17. In this particular embodiment, the height of guide baffle 16 is not readily adjustable.

A feeding screw 18, fastened to the side of top part 3, serves to convey the material to be classified into separation chamber 3, 4.

Top part 3 is designed to be separable at a flange 19, thus allowing the lower section of top part 3 together with guide baffle 16, bottom part 4, cylindrical container 5 and outlet funnel 6 to be removed as a coherent unit for inspection or cleaning purposes.

The particle classifier operates as follows:

Material to be classified is fed through screw 18 and drops toward the lower area of classification chamber 3, 4, where it is vigorously flushed through by air flowing in through guide blades 15. This results in a substantially complete breakup of grain clusters. The coarsest particles fall downward into the discharge funnel 6, and the remaining material is pulled upward by the separating air, within the baffle 16, and carried to separating wheels 7. That material is divided by separating wheels 7 into fine material and coarse material, with the cut-point between these groups determined by the selected velocity of the separating wheels.

The fine material passes with the separating air through the blades 9 and is then carried away through pipe sections 12 and outlet discharge 13. The coarse material rejected by the centrifugal action of blades 9 drops within the area of classification chamber 3, 4, outside of guide baffle 16, back to the bottom of the classification chamber. There, the coarse material is again intensively flushed through by the separating air in the area of guide blades 15, so that any fine material particles still adhering to the coarse particles are detached. Part of the coarse material now falls into the outlet funnel 6 and is carried out by the cell sluice mounted thereunder. The remainder of the coarse material is, together with new material fed in by feeding screw 18, carried back to the separating wheels 7.

In practice, the fine particle classifier formed by the wheels 7, whose particle classification size is independent of the quantity of material to be classified and of the distribution of particle sizes in that material, cooperates with a simple coarse particle classifier located in the area of guide blades 15, whose particle classification size is a function of the quantity of material to be classified. In particular, the particle classification size of this coarse classifier varies inversely with the load placed thereon, so that the particle classification size moves into the fine range with an increasing load and vice versa. This cooperation between the fine and coarse particle classifiers of classifier 1 has the effect that, during the starting phase, coarse material automatically accumulates in the classification chamber until, with a certain amount of material, the particle classification size of the coarse classifier corresponds to that of separating wheels 7. These properties of the aforedescribed particle classifier partly contribute to the fact that large quantities of material can be classified very precisely even in the extremely fine particle range, i.e. classification sizes of less than 8 micrometers can be achieved.

We claim:

1. A particle classifier comprising:

(a) a casing having
  (i) a classification chamber defining a vertical axis, and
  (ii) a tapering bottom part and a cylindrical top part;

(b) air inlet means secured to said bottom part of the casing at the bottom thereof for supplying air thereto having
  (i) a container with an inlet conduit being in fluid communication with the classification chamber, and
  (ii) a plurality of guide blades secured within the container and forming a blade ring concentric with the vertical axis of the classification chamber;

(c) means for supplying particulate material to be classified into the bottom part of said classification chamber of said casing and at a location above said air inlet means;

(d) a particle separating means mounted in the top part of the classification chamber having
  (i) at least two separating wheels of same shape and size, each wheel being mounted for rotation about its axis and including a multitude of blades positioned about the circumference of the wheel, extending parallel to its axis, and forming a multitude of openings for conducting air and fine particles entrained therewith into the interior of the separating wheel, and (ii) means connected to the separating wheels for rotating the separating wheels; and (e) discharge conduit means in communication with the interiors of the separating wheels for discharging from the classification chamber air and fine particles passing between the blades of the separating wheels and into the interiors thereof.

2. A particle classifier according to claim 1 wherein the axes of the separating wheels lie in a plane at right angles to the axis of the classification chamber.

3. A particle classifier according to claim 2 wherein the axes of the separating wheels extend radially relative to the axis of the classification chamber.

4. A particle classifier according to claim 3 wherein the discharge conduit means comprises an outlet conduit centrally located relative to the separating wheels.

5. A particle classifier according to claim 2 wherein:

(a) the axes of the separating wheels are parallel to each other; and (b) adjacent separating wheels are staggered relative to one another.

6. A particle classifier according to claim 1 wherein the axes of the separating wheels lie on the surface of a circular cone, the axis of the circular cone being the axis of the classification chamber.

7. A particle classifier according to claim 6 wherein the discharge conduit means comprises an outlet conduit centrally located relative to the separating wheels.

8. A particle classifier according to any one of claims 1 through 7 comprising control means to maintain the rotational speeds of the separating wheels the same for all the separating wheels.

9. A particle classifier according to any one of claims 1 through 7 further comprising a vertically extending tubular guide baffle supporated centrally within the classification chamber and spaced from the other wall thereof for conducting air and particulate material contained therewith upward to the separating wheels.

* * * * *